United States Patent [19]

Marmo et al.

[11] Patent Number: 4,740,276

[45] Date of Patent: Apr. 26, 1988

[54] FABRICATION OF COOLED FACEPLATE SEGMENTED APERTURE MIRRORS (SAM) BY ELECTROFORMING

[75] Inventors: Jay Marmo, Torrance; Joey T. Lee, Rancho Palos Verdes; David L. Krebs, Los Angeles; James R. Ranstrom, Buena Park, all of Calif.

[73] Assignee: The United States of America as represented by the Secretary of the Air Force, Washington, D.C.

[21] Appl. No.: 48,110

[22] Filed: May 8, 1987

[51] Int. Cl.[4] ..... C25D 1/06

[52] U.S. Cl. ..... 204/7

[58] Field of Search ..... 204/3, 4, 7

[56] References Cited

U.S. PATENT DOCUMENTS

| | | | |
|---|---|---|---|
| 1,871,770 | 8/1932 | Bart | 204/7 |
| 3,378,469 | 4/1968 | Jochim | 204/7 |
| 3,428,533 | 2/1969 | Pichel | 204/7 |
| 3,577,323 | 5/1971 | Pichel | 204/7 |
| 4,195,913 | 4/1980 | Dourte et al. | 350/292 |
| 4,374,002 | 2/1983 | Arnold et al. | 204/7 |

OTHER PUBLICATIONS

George A. BiBari, "Electroforming", in the Electroplating Engineering Handbook, 4th Ed., Van Nostrand Reinhold Company, 1984, pp. 474–490.

Precision Reflective Optics by Electroforming Technique, in Finishing Industries, vol. 2, 1978, pp. 40 and 42.

F. E. Bupp, M. Citron, and R. J. Reiner, "Integrated Test System–Beam Handling and Control (ITS/BHC), AFWAL-TR-82-4103, 1982.

*Primary Examiner*—T. M. Tufariello

*Attorney, Agent, or Firm*—Donald J. Singer; Fredric L. Sinder

[57] ABSTRACT

An electroforming method is described for making a cooled segmented aperture (SAM) mirror suitable for use with high energy laser irradiation. The method avoids the problems associated with discrete segment SAMs by using electroforming to fabricate a continuous faceplate having a surface shape of the desired array of segments and coolant channels just below the optical surface to provide improved performance under high energy laser irradiation. A master mirror is fabricated from discrete segments. Raised circular lands on the rear of the segments aid alignment of the segments. A negative faceplate is electroformed on the master mirror. A positive faceplate is electroformed on the negative faceplate. Cooling channels are electrical discharge machined into the back of the positive faceplate and additional material electrodeposited to close the channels. A manifold for coolant flow through the cooling channels and bosses for safety screws are attached to the back of the positive faceplate and held in place by a further electrodeposition. Large substrates are epoxy bonded to the electroformed negative and positive faceplate deposits before separation from their respective masters to prevent elastic deformation of the deposits. Separator bars are used to facilitate separation. The structure of the CSA mirror made from the method is also disclosed.

16 Claims, 8 Drawing Sheets

FABRICATION OF COOLED FACEPLATE SEGMENTED APERTURE MIRRORS (SAM) BY ELECTROFORMING

RIGHTS OF THE GOVERNMENT

The invention described herein may be manufactured and used by or for the Government of the United States for all governmental purposes without the payment of any royalty.

BACKGROUND OF THE INVENTION

The present invention relates generally to segmented aperture mirrors, and more specifically to their fabrication by electroforming.

A segmented aperture mirror (SAM) comprises a plurality of tightly packed mirror segments with identical surface curvatures mounted to a substrate structure of different curvature. SAMs have principally been used to smooth, or integrate, the spatial intensity variations of a laser beam, but other uses are possible depending on incident beam characteristics and segment and substrate geometries. One useful SAM for beam smoothing uses an array of square convex mirror segments mounted to a concave substrate structure to form a convex segmented aperture (CSA) mirror. A collimated beam of light incident on a CSA mirror is separated into many beams by reflection from individual segments. Each segment directs its portion of the reflected beam to overlap at the substrate focal plane. In this way, intensity variations in different areas of the incident beam are reduced by superimposing them.

U.S. Pat. No. 4,195,913 to Dourte et al teaches the fundamental construction and use of a convex segmented aperture mirror as an optical integrator. Its construction technique is sufficiently general to be feasible for other SAM geometries. Unfortunately, Dourte et al's construction teaching, including its segment construction, segment attachment method, segment separation and suggested water cooling of the substrate to which the segments are attached, limits both the accuracy and the level of incident energy allowable for such a device. Convex segmented aperture mirrors are generally used in the optical trains of test systems for studying the effects of high energy laser irradiation, requiring protection against heat distortion and other thermal effects. Individually cooling each segment has been suggested as a means for improving the thermal performance of a discrete segment CSA mirror under such high energy irradiation. This approach suffers from the complexity of a multiplicity of coolant connections required to cool each segment and the adverse impact of the connections on segment mounting.

Many of the problems associated with discrete segment mirrors can be overcome by fabricating a seamless continuous faceplace, containing the desired SAM optical surface, by electroforming. Electroforming is a variation of electroplating involving the formation of a removable layer of metal which conforms exactly to the shape of the surface of a master. U.S. Pat. No. 3,428,533 to Pichel, U.S. Pat. No. 3,378,469 to Jochim, and U.S. Pat. No. 1,871,770 to Bart, for example, teach various uses of electroforming to make reflecting mirrors from a continuous master. While each of these patents, and the other electroforming prior art, provide valuable teachings adaptable to constructing a SAM, those teachings are insufficient to successfully construct an electroformed SAM able to withstand high energy laser irradiation.

For example, electroforming of optical surfaces requires control of bath and plating parameters to limit the springback of the electroform, when separated from the master, to acceptable levels. Electroformed optics are generally thin (less than 0.100") and freestanding when removed from the master. Adding cooling will result in a thin unsupported cooled faceplate with unacceptable distortions due both to springback and deformation during separation form the master and to induced cooling loads. Bonding a rigidizing substrate to the faceplate to minimize these distortions can create distortions of its own due to bond shrinkage or substrate stresses. Additionally, the properties of the bonding material must not reduce the stiffness and stability of the substrate. The bonded assembly must maintain its integrity and not disbond.

It is, therefore, a principal object of the present invention to provide an electroforming method for making a cooled CSA type SAM suitable for use with high energy laser irradiation.

It is another object of the present invention to provide an electroforming method for fabricating cooled SAMs of other geometries suitable for use with high energy laser irradiation.

It is a further object of the present invention to provide an improved method for fabricating discrete segment SAMs for use as electroforming masters or for use with low power laser irradiation.

It is yet another object of the present invention to provide an improved bonding method for rigidizing thin optical electroforms.

A feature of the present invention is that a very large SAM assembly may be fabricated by assembling onto a rigid structure many identical SAM tiles made from a small tile master.

Another feature of the present invention is that it allows fabricating many SAM tiles at once from multiple working masters made from a single master, thereby reducing the cost and complexity of fabricating a large SAM assembly.

An advantage of the present invention is that it provides an optical quality cooled surface without the prior art complexity, sealing problems and absorption losses of a conventional CSA type SAM with discrete, cooled segments.

SUMMARY OF THE INVENTION

The present invention provides an electroforming method for making a SAM suitable for use under high energy laser irradiation. The unique discovery of the present invention is that the problems and limitations of discrete segment SAMs can be avoided by electroforming a continuous faceplate which contains coolant channels just below the optical surface. The continuous faceplate is bonded to a rigidizing substrate to prevent distortion of the faceplate during or after separation from a master. The present invention includes the discovery that a circular ring land on the rear surface of individual master segments provide greatly improved segment alignment and rigidity over prior art mounting surfaces.

Accordingly, the present invention is directed to a method for making a CSA mirror tile comprising the steps of providing a master, electroforming a negative faceplate on the master, bonding a first substrate to the back of the negative faceplate, separating the negative faceplate from the master, electroforming a positive faceplate over the negative faceplate, forming coolant channels into the back of the positive faceplate, electrodepositing an additional layer of material to enclose the coolant channels, then opening passages through the additional layer to connect at least one manifold, positioning the manifold over the additional electrodeposited layer and electrodepositing another layer of material to attach and seal the manifold, bonding a second substrate to the last electrodeposited layer, and finally separating the positive faceplate assembly from the negative faceplate.

The invention also includes using separator bars to facilitate separation of masters from electroformed deposits. The separator bars are removably attached to the master and the surface of the master passivated to prevent permanent bonding to the electroform. The surface of the separator bars are activated to allow permanent bonding to the electroform. Separation is achieved merely by unattaching the separator bars from the master and applying a force through the separator bars to separate the deposit from the master. The force may be applied by attaching the separator bars to the master with threaded bolts that extend through oversized threaded holes in the master to threaded holes in the separator bars, then removing the bolts and replacing with larger bolts that engage the threads in the master and push against the separator bars.

The invention additionally includes safety screw bosses held in place by electrodepositing a layer of material over them.

Construction of the coolant channels may include the steps of, before electrodepositng the layer of material to enclose the channels, first filling the channels with wax and coating the wax with a conductive coating. After separating the positive faceplate assembly from the negative faceplate, the wax is melted and the coolant channels flushed of wax.

The invention further includes using nickel as the electroforming material and for the substrates. The present invention also includes electrodepositing a layer of gold to provide to the faceplate a highly reflective surface.

The invention additionally includes the method of bonding a thin electroform on a master to a rigidizing substrate by compressing the substrate against the bonding adhesive to remove voids and to control bond thickness, and curing the adhesive bond with only the weight of the substrate on it. Screws threaded into threaded bosses attached to the electroform may be used to hold the bond in compression after curing to protect the bond and prevent disbonding.

The invention includes fabricating the master CSA mirror by providing a plurality of identical segments and attaching them to a master attachment plate having a preselected curvature. Spacer bars and separator bars align the segments and provide for later separation of an electroform from the master.

The invention further includes raised circular lands on the rear faces of the segments for aligning the segments to the master attachment plate.

The invention additionally includes making a CSA mirror from a plurality of mirror tiles by attaching a plurality of mirror tiles to a backup plate, aligning the mirror tiles and attaching coolant fittings to the backup plate.

The invention also includes a CSA mirror structure comprising an electrodeposited concave faceplate having a surface comprising a plurality of seamlessly connected convex segments with coolant channels through the faceplate behind its front surface, the coolant channels connected with at least one manifold, and a reinforcing substrate bonded to the back of the concave faceplate.

DESCRIPTION OF THE DRAWINGS

The present invention will be more clearly understood from a reading of the following detailed description in conjunction with the accompanying drawings wherein.

DETAILED DESCRIPTION

Figure 1:
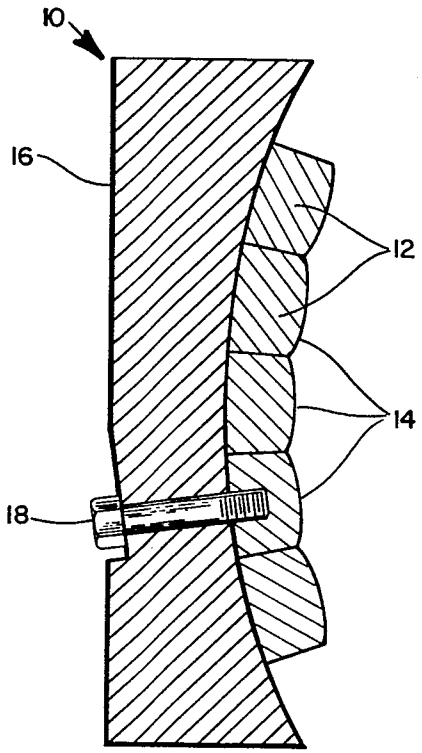
Fig. 1 PRIOR ART
FIG. 1 is a side cross-sectional view of a prior art CSA-type SAM.

Referring now to FIG. 1 of the drawings, there is shown a side cross-sectional view of a prior art convex segmented aperture, or CSA, mirror 10. CSA mirrors are used to smooth the spatial intensity variations of incident electromagnetic beams and are one type of the more general segmented aperture mirror, or SAM. The CSA mirror fabrication method described below may be used to make many other SAM configurations and is an example embodiment of the general method.

Prior art CSA mirror 10 is constructed from a plurality of substantially square mirror segments 12, but which may be any shape that allows close packing of all segments. Faces 14 of segments 12 are convex for a CSA type SAM, but may be any desired curvature. Prior art segments 12 attach to a substantially spherically concave substrate 16 to hold them in a desired orientation. Attachment screws 18 hold segments 12 to substrate 16.

Figure 2:
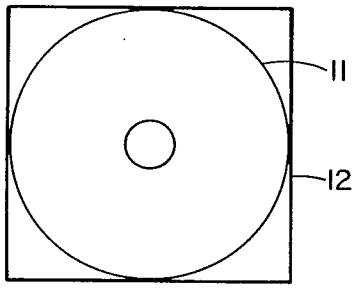
FIG. 2 is a rear view of a prior art individual square mirror segment used in making a master.
Figure 3:
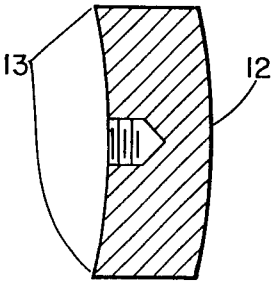
FIG. 3 is a side cross-sectional view of a prior art square mirror segment.

Raised circular disks 11 on the back of a segment 12, as shown in FIG. 2. contact and align each segment 12 against substrate 16. The FIG. 3 side cross-sectional view of segment 12 shows the sharp edged corners 13 of the edges of disk, or land, 11. The sharp land edges 13 create high stresses against substrate 16 when mounted. This causes an unstable mounting which can deform the attachment surface and misalign the segment. Additionally, disk land 13 cannot be used with convex attachment surfaces because the flat land will rock about its center, creating an unstable mounting.

The fabrication method described below makes a 10 segment wide by 20 segment tall water cooled CSA mirror by electroforming. The CSA mirror is assembled from two 10 by 10 segment array sub-elements called tiles. The two tiles are made from the same master and are aligned and held by a backup plate which includes coolant interface fittings and provision for adjusting alignments. The method may be easily modified for other cooled or uncooled SAM configurations using one or many tiles of different geometries. The figures mostly show a 4 segment by 4 segment array tile for drawing simplicity and to aid understanding.

Figure 4:
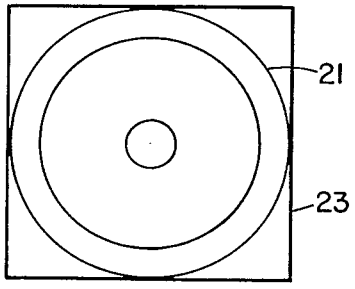
FIG. 4 is a rear view of a square segment using the teachings of the present invention.
Figure 5:
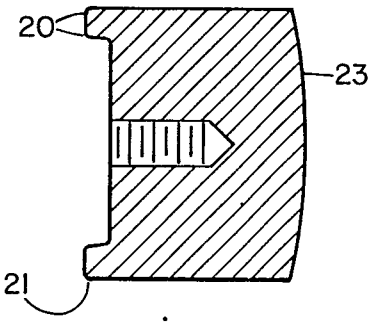
FIG. 5 is a side cross-sectional view of the square segment of FIG. 4.

Individual tiles are made from masters. The first step to fabricate a master is to fabricate individual segment assemblies. FIGS. 4 and 5 are, respectively, a rear and a side view of a mirror segment 23 incorporating the teachings of the present invention. Segments 23, as is most of the master, are made of PH 17-4 stainless steel, chosen for its polishablity, purity, corrosion resistance, hardness, stability and coefficient of thermal expansion. Segment 23 has a narrow raised ring or land 21 on the rear of the segment. Unlike the sharp edges 13 of prior art segments 12, the edges 20 of raised ring 21 are radiused, or rounded. Land 21 improves the accuracy and alignment of assembly of the segment to its substrate. Land 21 defines the contact area of a mounted segment against its substrate. Unlike prior art disk land 13, land 21 will firmly position itself against nearly any shaped surface and will not rock over a convex surface. Segment 23 is also make thicker than prior art segment 12 to reduce deformation of the segment surface from mounting forces.

Figure 6:
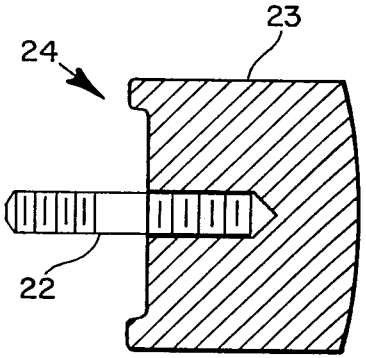
FIG. 6 is a side cross-sectional view of the segment of FIGS. 6 and 7 showing the attachment of a mounting stud.

FIG. 6 shows a completed segment assembly 24 comprising a segment 23 and a threaded-in stud 22. Stud 22 is also made of PH 17-4 stainless steel. Thread locking adhesive prevents stud 22 from loosening. Stud 22 is made sufficiently more flexible than segment 23 to help prevent misalignment between segment 23 and the substrate.

Figure 7:
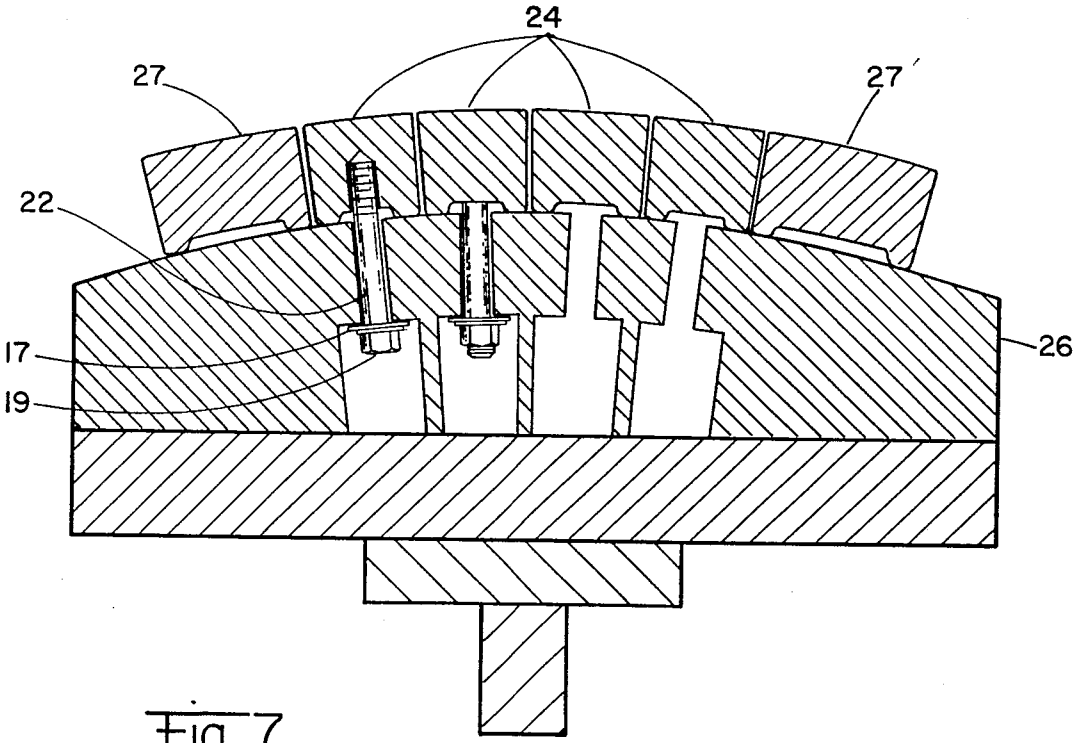
FIG. 7 is a side cross-sectional view of an assembled convex polishing fixture for polishing convex segments.

FIG. 7 shows a spherically convex polishing fixture 26 for polishing segments 24. Segments 24 are attached to polishing fixture 26 by inserting segment stud 22 into a hole drilled normal to the convex surface of fixture 26. Spherical washer set 17 and self-locking nut 19 secure the segments onto the fixture. Segments 24 are ground and polished together until the desired surface is obtained. Polishing fixture 26 includes bolsters 27, made of the same material as segments 23, to prevent roll off of the outer segment 24 during grinding and polishing. Gaps between segments 24 are filled with wax or RTV silicone to reduce drag out of polishing compound during finishing operations.

Figure 9:
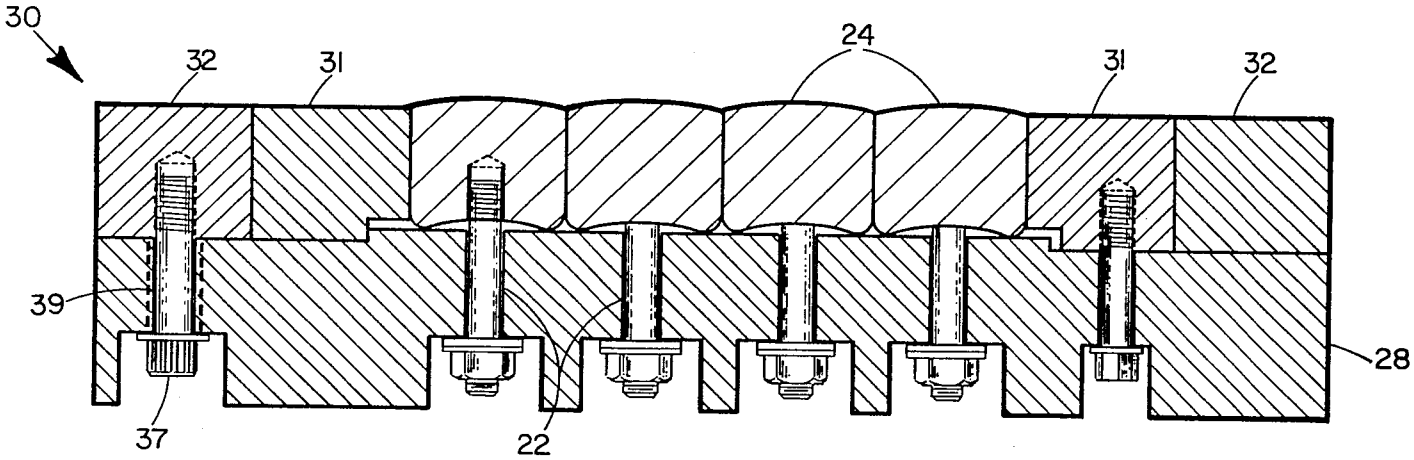
FIG. 9 is a side cross-sectional view of an assembled master for a SAM.
Figure 8:
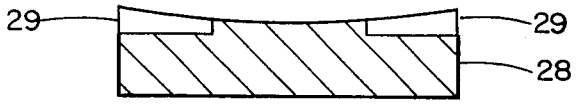
FIG. 8 is a side cross-sectional view of a rough polished master attachment plate with attached temporary bolsters for polishing.

Ground and polished segments 24 are attached to a master attachment plate 28, shown in FIG. 8, to make the master. Attachment plate 28 is prepared by grinding and polishing to achieve its desired, in the case of a CSA mirror, concave shape. Master attachment plate bolsters 29 serve the same function during grinding and polishing of attachment plate 28 as bolsters 27 for segments 24. FIG. 9 is a cross-sectional view of an assembled master 30. The curvature of attachment plate 28 of FIG. 8 is not shown in FIG. 9 and later figures. Segments 24 are attached by studs 22 in the same manner as they were attached to polishing fixture 26. Alignment of segments 24 is achieved by first assembling spacer bars 31 to attachment plate 28 with attachment bolts 15. Spacer bars 31 form a precise 90 degree corner for alignment of segments 24. Accurate outer dimensions of segments 24 permit nearly continuous contact between adjacent segments 24, thereby providing a nearly continuous surface for replication. Alignment of segments 24 occurs automatically when each segment 24 is tightened against attachment plate 28. No further adjustments are required. After attachment of all segments 24, remaining spacer bars 31 are attached to lock the segments in place and prevent rotation. Assembly of master 30 is completed by attaching separator bars 32 for use in later steps. Separator bars 32 are made of OFHC Copper.

Intermediate masters, or negatives, must be electroformed from master 30 to obtain the desired positive electroforms. A benefit of using a positive master is that intermediate electroformed negative masters can be produced more economically than a positive master and many negative masters can be electroformed from a single positive master. Ths reduces the cost and time required to make a large SAM from a number of individual tiles.

Prior to depositing the first electroform, the surface of the assembled master 30 must be prepared. Successful electroforming requires different surface preparations for different parts of the master 30. Some surface preparation sequences activate material for initial for further deposition, and other surface preparation sequences passivate material on which it is desired to prevent a bond between the material and the deposit. Prior to electroforming, the master 30 is passivated by immersion in a potassium-dichromate solution. The separator bars 32 are then activated in a separate step without disturbing the passive layer on the face of the master 30. This will produce a selective electrodeposited nickel bond to the separator bars while preventing a bond to master segments 24.

Figure 10:
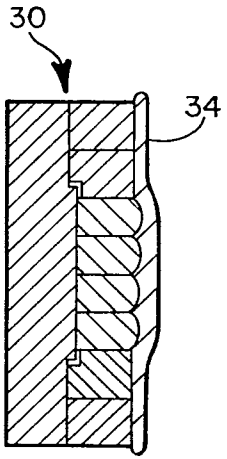
FIG. 10 is a side cross-sectional view of an assembled master with an electroformed negative faceplate.

To make the first electroformed negative master, an approximately 0.080 inch thickness of nickel is electrodeposited on the face of master 30 to make a negative faceplate 34, shown in FIG. 10. The thickness of the electrodeposited nickel "grow" comprising the electroformed negative faceplate 34 may range with good results from about 0.040 inch to about 0.250 inch. Care should be taken to use the best nickel plating practices known in the art to precisely replicate the master 30 surface into negative faceplate 34.

Figure 11:
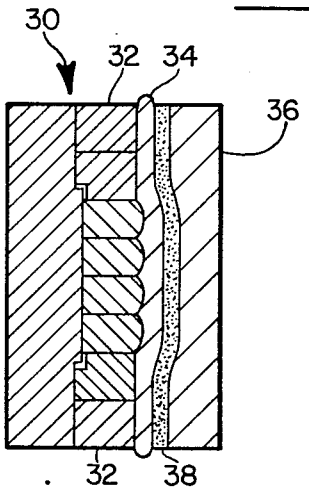
FIG. 11 is a side cross-sectional view of the negative faceplate bonded to a substrate while still attached to the master.

Following its electroforming, negative faceplate 34 is bonded to a conforming nickel substrate 36, as shown in FIG. 11. Bonding is performed using a low temperature cure two part epoxy 38 bond. The thick substrate 36 provides support to the thin negative faceplate 34 to allow its later separation from the master 30 without distortion.

This use of a substrate is an important element in making stable, high accuracy electroforms. Even in low stress electroforms, the residual internal stress created during deposition causes hundreds of waves of distortion upon removal from a master or mandrel. The use of electroformed optics has therefore generally been limited to date to applications which do not require accurate optical surfaces. If the deposit is annealed before removal, the thermal expansion differential between deposit and mandrel will result in a stable stress-free deposit, but with a distorted surface. An exact match of thermal expansion between the deposited part and the mandrel is difficult to achieve with common master materials and the material properties of the electroform are much reduced after annealing. The thick substrate and thin faceplate combination strike a balance between the residual stress in the deposit and the stiffness of the faceplate to virtually eliminate residual stress distortion of the optical surface while rigidizing the faceplace. Conforming substrate 36 allows a uniform bond 38 thickness which minimizes faceplate distortions from cure shrinkage of the bonding material. Bonding occurs while the faceplate remains attached to master 30 so that cure forces to not directly act on faceplate 34, but are resisted by the entire master assembly. A filled epoxy bonding material, Hysol TM 9321, works well due to its low shrinkage, relatively high elastic modulus, good bond strength and relatively low coefficient of thermal expansion. Other suitable bonding materials may be used.

Before bonding negative substrate 36 to negative faceplate 34, its surface is prepared to remove surface contaminants. Bonding material 38 is spread on the back of negative faceplate 34 and substrate 36 placed on top. The FIG. 11 assembly is then squeezed on a bonding fixture to eliminate voids and to create an uniform bond thickness. It is then placed inside an oven at 120° F. to cure the epoxy. Once inside the oven, all force other than the weight of substrate 36 is removed. This allows substrate 36 to bond to negative faceplate 34 in a free state and inhibits formation of stresses across bond line 38 that would distort negative faceplate 34 after removal from master 30.

Figure 12:
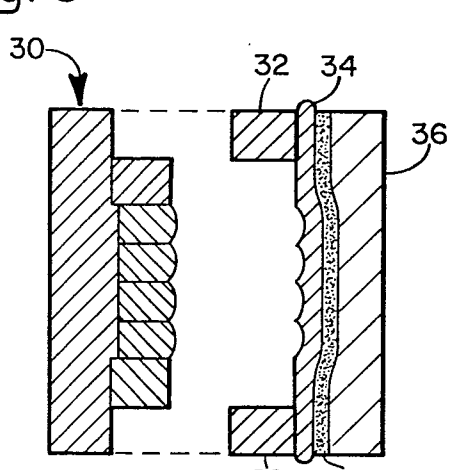
FIG. 12 is a side cross-sectional view of the negative faceplate and substrate, forming a negative assembly, immediately after separating from the master showing master separator bars still attached to the negative assembly.

Separation of negative faceplate 34 from master 30 is controlled by separator bars 32. A weak bond forms between the passivated surface of master 30 and the surface of negative faceplate 34, due in part to ambient air pressure. A strong electrochemical bond, however, is formed between the activated surface of the OFHC copper separator bars 32 and negative faceplate 34. If negative faceplate 34 was restrained only by its weak bond to master 30, it could prematurely release due to mechanical forces prior to or during bonding. Once released, the precise replication of the surface of master 30 would be lost. Separator bars 32 not only prevent premature release, but also provide a soft load path through which to break the weak bond between master 30 and negative faceplate 34. After bond 38 has cured, separator bar attachment bolts 37, shown in FIG. 9, are removed and replaced with larger diameter bolts (not shown) screwed into threads 39 in master attachment plate 28. The larger diameter bolts push against the underside of separator bars 32 and gently separate negative faceplate 34 from master 30. The separation process is shown schematically in FIG. 12. Master 30 can be cycled back into the process to produce more negatives.

Figure 13:
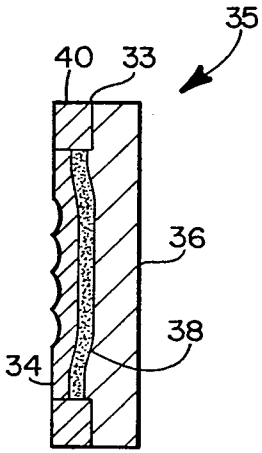
FIG. 13 is a side cross-sectional view of the negative assembly after machining and installation of negative separator bars.

After separation, separator bars 32 are machined off negative faceplate 34 and recessed pockets 33 milled into the negative faceplate 34 for flush fitting of negative separator bars 40, shown in FIG. 13. Negative separator bars 40 serve the same function as separator bars 32 for the later removal of an electroformed positive faceplate assembly. Negative faceplate 34 and its bond 38 to substrate 36 are protected during machining to prevent damage. Cover plates (not shown) are clamped against faceplate 34 along its periphery to prevent peeling of bond 38 during machining. Holes are drilled through faceplate 34 and bond 38 to intersect with pre-drilled holes in substrate 36. Flat head screws are inserted into countersunk holes and tightened against spherical washers and self-locking nuts to place bond 38 in compression along the outside edge of faceplate 34. Negative faceplate 34 and substrate 36 together form a negative faceplate and substrate assembly 35.

Figure 14:
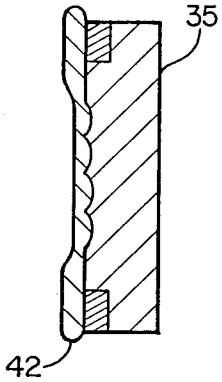
FIG. 14 is a side cross-sectional view of the negative assembly with an electroformed positive faceplate.

FIG. 14 shows a nickel positive faceplace 42 electroformed on negative faceplate and substrate assembly 35 to an about 0.060 inch thickness. Prior to electroforming of positive faceplate 42, negative assembly 35 is prepared for electroforming in the same manner as master 30 previously. The thickness of positive faceplate 42 may range between about 0.040 inch to about 0.250 inch, depending upon the application. As previously discussed, careful attention to the best electroforming practices is necessary. A pinhole-free deposit is necessary to prevent coolant leakage later.

Figure 15:
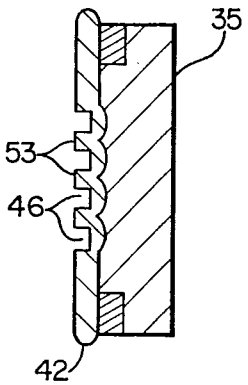
FIG. 15 is a side cross-sectional view of the positive faceplate deposited on the negative assembly showing open channels machined in the rear surface of the positive faceplate.

FIG. 15 shows a schematic cross-section of positive faceplate 42 after machining to form open cooling channels 46 in its rear surface. Electrical discharge machining is used to allow the fabrication of all cooling channels 46 in one pass and to reduce the risk ot positive faceplate 42 of machining damage or distortion. The dielectric fluid used is temperature controlled and the metal removal rate is kept low. Channels 46 extend to within 0.035 inch of the front surface of positive faceplate 42 and follow its sherical curvature. Each channel 46 is 0.120 inch wide and 0.020 inch deep, but other geometries are possible.

Figure 16:
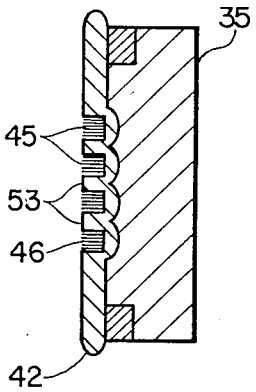
FIG. 16 is a side cross-sectional view of the positive faceplate deposited on the negative assembly showing the channels filled with wax.

After channels 46 are formed, several steps are taken to ensure successful closure of channels 46 by additional grows over positive faceplate 42. Lands 53 of channels 46 are carefully wet sanded to remove any surface scratches and imperfections. Any depressions in the land 53 surface will prevent bonding and can lead to failure of positive faceplate 42 under coolant pressure loading. Open cooling channels 46 are filled with a wax 45, Rigidax TM Compound WI Light Blue, which may be obtained from the M. Argueso Company, Mamaroneck, N.Y., as shown in FIG. 16. Wax 45 is leveled with lands 53 with a hot iron and wet sanded to remove residual wax 45 from lands 53. The wax surface is made conductive by burnishing wax 45 with silver powder. A solution of SNAP TM, an organic wetting agent available from Allied-Delite Products Division of Witco Corp., Melrose Park, Ill., is used to remove excess silver powder from wax 45 just prior to nickel deposition.

After preparing the wax 45 surface, the rear of positive faceplate 42 must be reactivated so that the second grow will adhere intimately to the first. Anodic phosphoric/sulfuric acid cleaning, followed by a cathodic sulfuric acid activation, has worked successfully, but other techniques may be possible. In the anodic step, positive faceplate 42 becomes an anode and the electrical current created removes surface impurities by dissolution of metal from the rear of faceplate 42. The cathodic step bombards the rear of faceplate 42 with hydrogen to activate the surface for deposition. This procedure produces the high strength nickel to nickel bonds required for closeout of the electroformed coolant channels.

Figure 17:
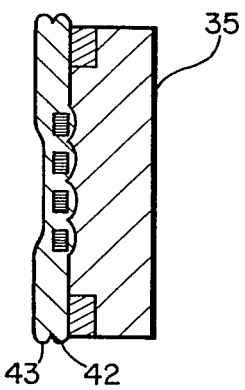
FIG. 17 is a side cross-sectional view of the positive faceplate deposited on the negative assembly showing a second electrodeposited layer enclosing the wax-filled channels to form coolant channels in the positive faceplate.

Following the described reactivation procedure, a second layer or grow 43 is deposited over faceplate 42 to enclose channels 46 and bond to lands 53, shown in FIG. 17.

Figure 19:
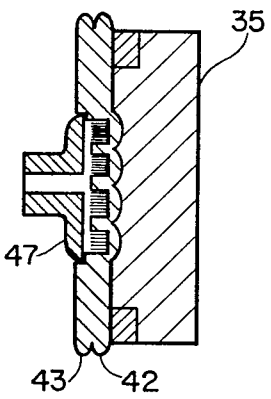
FIG. 19 is a side cross-sectional view of the positive faceplate deposited on the negative assembly with the coolant manifold mounted over the coolant channels.
Figure 18:
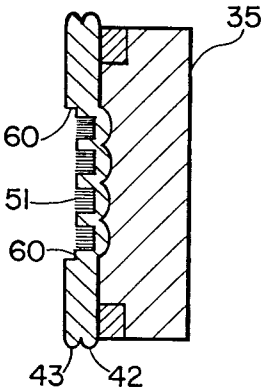
FIG. 18 is a side cross-sectional view of the positive faceplate deposited on the negative assembly after machining through the second electrodeposited layer to intersect the wax-filled coolant channels and machined mounting surfaces for mounting a manifold.

Two manifold passages 51, for inlet and outlet of coolant, are electrical discharge machined through the second grow 43 to intersect channels 46 at each of their ends and just expose the waxed surface, as shown in FIG. 18. The view in FIGS. 18–23 is sectioned not at the midline of the tile, but along a line through either ends of coolant channels 46 to show the connection of coolant manifold 47. Coolant manifold 47 includes an inlet and outlet, one of which is hidden behind the other in the figures, to provide a path for coolant flowing through coolant channels 46. Mounting surfaces 60 for coolant manifold 47, shown in FIG. 19, are also machined into the rear of faceplate 42 to provide a flat mounting interface on an otherwise curved surface. Mounting surfaces for other details to be electroformed into the faceplate 42 rear surface, such as screw bosses 48 shown in FIG. 24, are machined at this time.

After cleaning the faceplate 42 rear surface with cold solvent, coolant manifold 47 and other details are installed into faceplate 42, 43 as shown in FIG. 19. Inlet and outlet manifold, or manifolds, 47 and other details are held in place with conductive epoxy prior to being locked into faceplate 42, 43 with a third grow. The assembly shown in FIG. 19 is activated for regrowing by the same method as described for the second grow 43.

Figure 20:
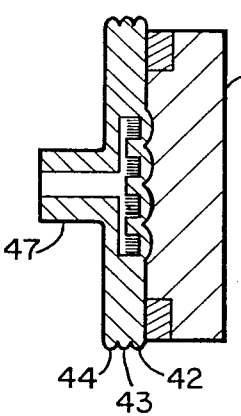
FIG. 20 is a side cross-sectional view of the positive faceplate deposited on the negative assembly after electrodepositing a third layer over the manifold and other rear surface details to seal them into the faceplate.

Third grow 44 forms an assembly shown schematically in FIG. 20. Third grow 44 is approximately 0.025 inch thick and locks in place manifold 47 and other details. This technique provides a completely enclosed leak proof coolant path and a zero stress method for bonding detail parts to the rear of faceplate 42, 43.

Figure 21:
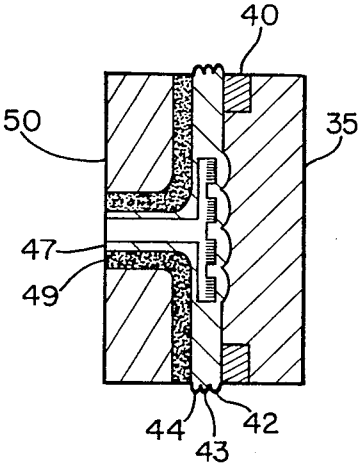
FIG. 21 is a side cross-sectional view showing a substrate bonded to the back of the positive faceplate to form a positive faceplate assembly, or tile.

FIG. 21 shows the assembly after bonding a comforming substrate 50 to the positive faceplate 42, 43 and 44. Substrate 50 is machined to allow clearance for manifold 47 and details protruding from the back of faceplate 42, 43, 44. It is bonded using the same process and tooling as described for bonding negative substrate 36 to negative faceplate 34. Substrate 50, which appears to be two pieces in FIG. 21, is one piece having a pair of cutout openings for manifold 47 and other details.

Figure 22:
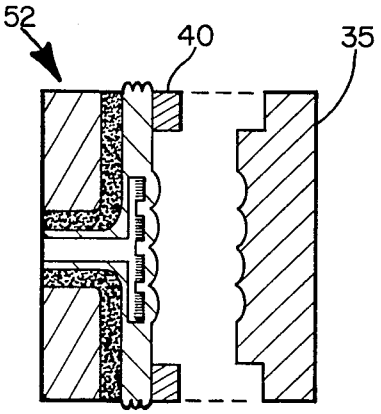
FIG. 22 is a side cross-sectional view of the positive faceplate assembly after separation from the negative assembly showing the negative separator bars still attached to the positive faceplate.

FIG. 22 shows the positive faceplate assembly 52 after separation from negative master 35. Separation is accomplished using negative separator bars 40 in a manner similar to the method using master separator bars 32 to separate negative faceplate 34 from master 30. The negative separator bars 40 are replaced on negative master 35 to make it ready to be used to fabricate another positive faceplate.

Figure 23:
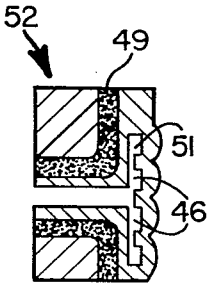
FIG. 23 is a side cross-sectional view of the positive faceplate assembly, or tile, after final machining to remove the negative separator bars, unnecessary border areas and to allow for close fitting of the tiles along one edge.
Figure 24:
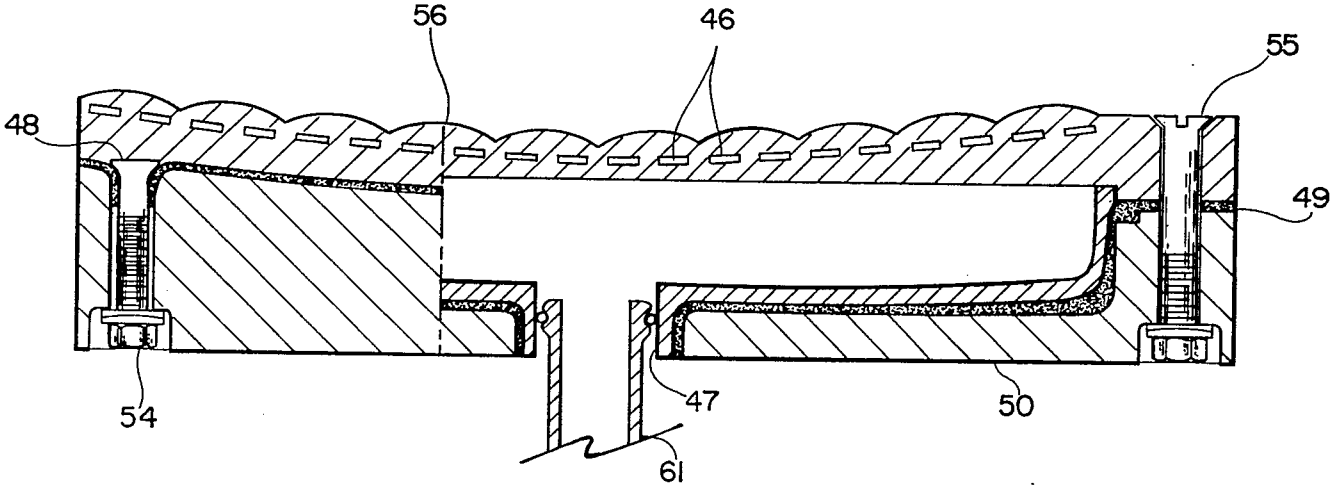
FIG. 24 is a front view of the positive faceplate, or tile, after final machining, showing the visible safety screws along the borders of the tile which do not contact another tile.

FIG. 23 shows positive faceplate assembly, or tile, 52 after careful machining to its final dimensions. Tile 52 is close trimmed along one edge and safety screws are installed around its entire periphery. Bond 49 is protected at all times during the machining operations in the same manner as described for negative master 35. Wax 45 in channels 46 and passages 51 is removed from tile 52 by elevating its temperature to 200° F. and flushing out the coolant path under slight pressure (50 psig) with perchlorethylene at approximately the same temperature.

FIG. 24 shows a more detailed cross-sectional view of tile 52 highlighting its principal features. Its surface is an exact replication of master surface 30, but it now contains coolant channels 46 just beneath its surface. Channels 46 are connected to manifold 47 through passages 51 machined at both ends of channels 46. Positive faceplate 42, 43, 44 exists as a single solid nickel piece despite its formation by three separate grows. It is bonded to its rigid substrate 50 with a filled epoxy 49 which supports and stiffens it without distorting it. Faceplate bond 49 is protected form excessive stress and disbonding by safety screws 54 and 55 around its entire periphery. Safety screws 55 are bolted directly through faceplate 42 where sufficient border outside the optical surface 56 is available. Safety screws 54 are attached indirectly to the rear of faceplate 44 through the use of bosses 48 along edges close trimmed to optical surface 56. Safety screws 54 and 55 keep bond 49 in compression at all exposed edges and greatly reduce the risk of bond failure. Deformations under the optical surface caused by safety screws 54 are controlled by the design of screw boss 48 and its attachment to faceplate 44. O-ring coolant fittings 61 are installed in manifold 47. No coolant or coolant forces directly contact bond 49 and all coolant paths are contained in nickel faceplate 42 and manifold 47.

Figure 25:
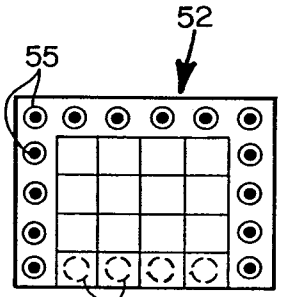
FIG. 25 is a more detailed cross-sectional view of a CSA type SAM positive tile; and, FIG. 26 is a side view of a CSA assembly showing two tiles attached to a back-up plate.

FIG. 25 shows a finished tile 52 ready for final assembly and alignment. Safety screws 55 in the border area outside the optical surface are shown extending through tile 52 and safety screws 54, hidden in this view, are shown by dashed lines. Depending upon the application, tile 52 may be used with its bare nickel surface, or the surface reflectivity may be enhanced through additional optical coatings, such as electrodeposited gold. Low temperature vapor deposited coatings or electroplated coatings may be used without otherwise affecting the tile.

Figure 26:
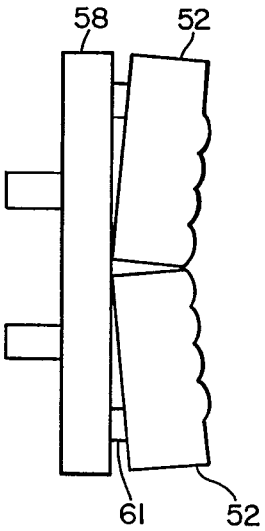

FIG. 26 shows a final assembly of a two tile array. Tiles 52 are assembled and co-aligned on a backup plate 58, which contains connections for coolant interface fittings 61 and the tile adjustment mechanisms.

The disclosed method for making a CSA mirror successfully demonstrates the use of electroforming to fabricate cooled segmented aperture mirrors using a thin cooled faceplate low distortion bonded to a rigid conforming substrate. Although the disclosed use is specialized, all or part of the disclosed process will find application in other areas of optical fabrication and replication. While it is a novel way to make cooled surfaces, the disclosed techniques can be applied to fabrication of uncooled optics also.

It is understood that certain modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

We claim:

1. A method for making a cooled segmented aperture mirror tile, comprising the steps of:

(a) providing a master;

(b) electroforming a first layer of material onto the face of the master to form a negative faceplate having a front surface facing the master and a rear surface;

(c) bonding a first conforming substrate to the rear surface of the negative faceplate;

(d) separating the negative faceplate and substrate assembly from the master;

(e) electroforming a second layer of material onto the front surface of the negative faceplate to form a positive faceplate having a front surface facing the front surface of the negative faceplate and a rear surface;

(f) forming coolant channels in the rear surface of the positive faceplate;

(g) electrodepositing a third layer of material over the second layer to enclose the coolant channels;

(h) opening passages through the third layer to the coolant channels;

(i) positioning at least one manifold against the third layer so that the manifold operative interconnects to the coolant channels through the opened passages;

(j) electrodepositing a fourth layer of material over the third layer and manifold to attach and seal the manifold to the third layer;

(k) bonding a second conforming substrate to the fourth layer, the second conforming substrate having an opening for the manifold; and, (l) separating the positive faceplate from the negative faceplate, whereby the positive faceplate, third and fourth layers, manifold and second substrate comprise the mirror tile.

2. The method for making a cooled segmented aperture mirror tile according to claim 1, further comprising after step (a) the steps of:

(a) removably attaching at least one separator bar to the master;

(b) passivating the surface of the master to prevent permanent bonding to an electroform;

(c) activating the surface of the separator bar to allow permanent bonding to an electroform; and, (d) whereby step (d) is characterized as detaching the separator bar from the master and applying a force through the bar to separate the negative faceplate from the master.

3. The method for making a cooled segmented aperture mirror tile according to claim 1, further comprising after step (d) the steps of:

(a) removably attaching at least one separator bar to the negative faceplate;

(b) passivating the surface of the master to prevent permanent bonding to an electroform;

(c) activating the surface of the separator bar to allow permanent bonding to an electroform; and, (d) whereby step (1) is characterized as detaching the separator bar from the negative faceplate and applying a force through the bar to separate the positive faceplate from the negative faceplate.

4. The method for making a cooled segmented aperture mirror tile according to claim 1, further comprising the steps of:

(a) positioning a plurality of safety screw bosses against the third layer before electrodepositing the fourth layer of material;

(b) electrodepositing the fourth layer of material over the third layer and safety screw bosses to attach the safety screw bosses to the third layer; and, (c) after the step of separating the positive faceplate from the negative faceplate, installing safety screws into the safety screw bosses to hold the second substrate against the positive faceplate.

5. The method for making a cooled segmented aperture mirror tile according to claim 1, further comprising after step (f) the steps of:

(a) filling the coolant channels with wax and coating the wax with a conductive coating; and, (b) after the step of separating the positive faceplate from the negative faceplate, melting the wax and flushing the coolant channels with solvent.

6. The method for making a cooled segmented aperture mirror tile according to claim 1, wherein the electroformed material and the first and second substrates are nickel.

7. A method for separating an electroform from a master, comprising the steps of:

(a) removably attaching at least one separator bar to the master;

(b) passivating the surface of the master to prevent permanent bonding to the electroform;

(c) activating the surface of the separator bar to allow permanent bonding to the electroform;

(d) electrodepositing the electroform over the master and separator bar;

(e) bonding the rear surface of the electroform to a rigid comforming substrate;

(f) detaching the separator bar from the master; and, (g) applying a force through the separator bar to separate the electroform from the master.

8. The method for separating according to claim 7, wherein the step of applying a force through the separator bars includes:

(a) before electrodepositing the electroform onto the master, attaching the separator bar to the master with at least one bolt which passes through an oversized threaded hole in the rear of the master and into a threaded hole in the separator bar;

(b) after electrodepositing the electroform onto the master, removing the bolt attaching the separator bar to the master and inserting a larger bolt to match the threaded hole in the master; and (c) turning the larger bolt to apply the force to the separator bars.

9. A method for bonding a thin electroform on a master to a rigidizing substrate, comprising the steps of:

(a) applying an adhesive to the surface of the electroform facing away from the master;

(b) positioning the substrate against the adhesive to form an adhesive bond;

(c) compressing the substrate against the electroform to remove voids in the adhesive bond and to control bond thickness; and (d) curing the adhesive bond under the pressure of the weight of the substrate only.

10. The method for bonding an thin electroform on a master to a rigidizing substrate according to claim 9, further comprising providing means for holding the bond in compression after curing.

11. The method for bonding a thin electroform on a master to a rigidizing substrate according to claim 10, wherein the means for holding the bond in compression comprises:

(a) attaching threaded bosses to the electroform prior to positioning the substrate against the adhesive; and, (b) installing screws through openings in the substrate to screw into the threaded bosses.

12. The method for bonding a thin electroform on a master to a rigidizing substrate according to claim 10, wherein the means for holding the bond in compression comprises:

(a) screws extending through openings in the electroform and in the substrate, and, (b) nuts threaded on the screws.

13. A method for making an electroforming master for a segmented aperture mirror, comprising:

(a) making a plurality of identical segments;

(b) making a master attachment plate having a preselected curvature;

(c) attaching the segments to the master attachment plate so that gaps between segments are minimized;

(d) attaching spacer bars to the master attachment plate for aligning the segments; and, (e) attaching separator bars to the master attachment plate outside the spacer bars for later separating an electroform from the electroforming master.

14. The method for making an electroforming master according to claim 13, wherein each segment has on its rear face a raised circular land for aligning the segment to the master attachment plate.

15. A method for making a cooled segmented aperture mirror from a plurality of cooled segmented aperture mirror tiles having coolant fittings, comprising the steps of:

(a) providing a plurality of mirror tiles;

(b) providing a backup plate; and, (c) attaching a plurality of mirror tiles to the backup plate, aligning the mirror tiles, and attaching the coolant fittings to the backup plate.

16. A cooled segmented aperture mirror tile, comprising:

(a) an electroformed concave faceplate having a front surface and a rear surface;

(b) the front surface of the faceplate being continuous and defining the shape of a plurality of substantially identically curved front surfaces of substantially identical segments;

(c) a plurality of coolant channels defining passages through the faceplate below the front surface;

(d) at least one manifold operatively interconnected with the coolant channels; and, (e) a reinforcing substrate, having an opening for the manifold, bonded to the rear surface of the faceplate.

* * * * *

UNITED STATES PATENT AND TRADEMARK OFFICE

CERTIFICATE OF CORRECTION

PATENT NO. : 4,740,276

DATED : April 26, 1988

INVENTOR(S) : Jay Marmo et al

It is certified that error appears in the above-identified patent and that said Letters Patent is hereby corrected as shown below:

In Column 4, line 40, change "separating" to ---separation---.

In Column 6, line 18, change "make" to ---made---.

In Column 7, line 7, change "Ths" to ---This---.

In Column 7, line 14, change "initial for" to ---initial or---.

In Column 8, line 8, change "on" to ---in---.

In Column 9, line 30, change "Allied-Delite" to ---Allied-Kelite---.

In Claim 1, column 11, line 60, change "operative" to ---operatively---.

In Claim 8, column 13, line 14, after "and", add ---,---.

In Claim 9, column 13, line 25, after "and", add ---,---.

Signed and Sealed this

Twenty-second Day of November, 1988

*Attest:*

DONALD J. QUIGG

*Attesting Officer*

*Commissioner of Patents and Trademarks*